US010924844B1

(12) United States Patent
Hanna

(10) Patent No.: US 10,924,844 B1
(45) Date of Patent: Feb. 16, 2021

(54) FAR-FIELD MARINE SOUND SYSTEM INCLUDING COAXIAL SPEAKER HORN

(71) Applicant: Scott Hanna, Cullman, AL (US)

(72) Inventor: Scott Hanna, Cullman, AL (US)

( * ) Notice: Subject to any disclaimer, the term of this patent is extended or adjusted under 35 U.S.C. 154(b) by 99 days.

(21) Appl. No.: 16/294,094

(22) Filed: Mar. 6, 2019

Related U.S. Application Data

(60) Provisional application No. 62/639,901, filed on Mar. 7, 2018.

(51) Int. Cl.
*H04R 1/24* (2006.01)
*H04R 1/02* (2006.01)
*H04R 1/30* (2006.01)

(52) U.S. Cl.
CPC ..... *H04R 1/24* (2013.01); *H04R 1/025* (2013.01); *H04R 1/30* (2013.01); *H04R 2499/13* (2013.01)

(58) Field of Classification Search
None
See application file for complete search history.

(56) References Cited

U.S. PATENT DOCUMENTS 4,283,606 A * 8/1981 Buck ..... H04R 1/24 181/144
4,401,857 A * 8/1983 Morikawa ..... H04R 17/00 310/320
5,004,067 A * 4/1991 Patronis ..... H04R 1/30 181/188
5,526,456 A * 6/1996 Heinz ..... H04R 1/26 181/152
8,568,162 B1 * 10/2013 White ..... H04R 1/026 439/574
9,434,450 B1 * 9/2016 Swor ..... B63B 39/02
2012/0152162 A1 * 6/2012 Jordan ..... B63B 34/60 114/253
2015/0224914 A1 * 8/2015 Hasbrook ..... B60Q 1/0017 362/523

* cited by examiner

*Primary Examiner* — Paul W Huber
(74) *Attorney, Agent, or Firm* — C. Brandon Browning; Maynard, Cooper & Gale, PC

(57) ABSTRACT

A far-field, marine sound system including a coaxial speaker horn composed of a pair of horn bodies, each having an opening, a mouth and a sound pathway extending between the opening and the mouth. The pair of horns bodies include a first horn body contained within a second horn body, the horn bodies having aligned longitudinal axes. A first speaker is coupled to the first horn body and arranged to project sound into the first horn through the mouth, through the sound pathway and out of the first horn body through the opening, and a second speaker coupled to the second horn body and arranged to project sound into the second horn body through the mouth, through the sound pathway and out of the second horn body through the opening. The speaker horn bodies and speakers are contained with an aerodynamically-contoured housing.

17 Claims, 10 Drawing Sheets

FAR-FIELD MARINE SOUND SYSTEM INCLUDING COAXIAL SPEAKER HORN

RELATED APPLICATIONS

This application claims priority to U.S. Provisional Patent Application Ser. No. 62/639,901 titled, "Coaxial Horn Sound System," filed on Mar. 7, 2018, the entire contents of which are incorporated herein by reference.

FIELD OF INVENTION

The present invention is directed to a speaker system, and more particularly, to a far-field, marine speaker system using a coaxial speaker horn for delivering sound to a skier towed behind a watercraft.

BACKGROUND

Speakers may be used to play music for listeners in a variety of environments and during a variety of activities. For example, many people enjoy listening to music while participating in watersports, such as boating, skiing, wakeboarding or tubing. Conventional recreational watercrafts are commonly equipped with sound systems and audio equipment for playing music, such as a radio receiver and tuner, a music media interface or communication equipment for receiving audio data (e.g., streaming music via a network connection or connection to a media device, such as Bluetooth). The watercraft may also include amplifiers configured to adjust sound volume and speakers configured to play the music for listeners on the watercraft to hear. Such speakers are frequently configured as near-field speakers. The speakers may be located in a variety of places on the watercraft, but generally are installed near locations where listeners are likely to be, such as watercraft seating areas. In this regard, listeners may be positioned relatively close to a speaker and therefore may be better able to hear to the music the near-field speaker is playing, even in presence of certain amounts of noise from other sources.

In some situations, however, it may be impossible or impractical for some listeners to clearly hear music played through conventional near-field watercraft speakers. As an example, the watercraft may be used for towing a skier using a long tow rope. Because of the increased distance between speakers and the skier, music may be quieter or distorted when it reaches the skier because the skier is positioned further away from speakers on the watercraft. The skier may also change positions relative to the watercraft while skiing, such as in an arc defined by the length of the tow rope. Additionally, although many ski-specific watercrafts include speakers mounted on a tower, the skier still may be unable to hear music well for various reasons. For example, the skier may encounter wind noise, noise from the watercraft's engine or noise from the watercraft's or skier's movement through the water. Such noise can cause interference with the music the skier is trying to hear. In addition, watercraft tower-mounted speakers must be compact, and thus may not be large enough to project the music sufficiently to allow the skier to clearly hear the music. Further, playing music through the speakers at a volume the skier can hear requires increasing the volume to a level that is uncomfortable or harmful for listeners on the watercraft who are positioned close to the speakers. Thus, improved techniques for playing music for listeners participating in watersports are generally desired.

BRIEF DESCRIPTION OF THE DRAWINGS

The above and other features of the present disclosure, its nature and various advantages will be more apparent upon consideration of the following detailed description, taken in conjunction with the accompanying drawings in which.

DETAILED DESCRIPTION

Figure 1:
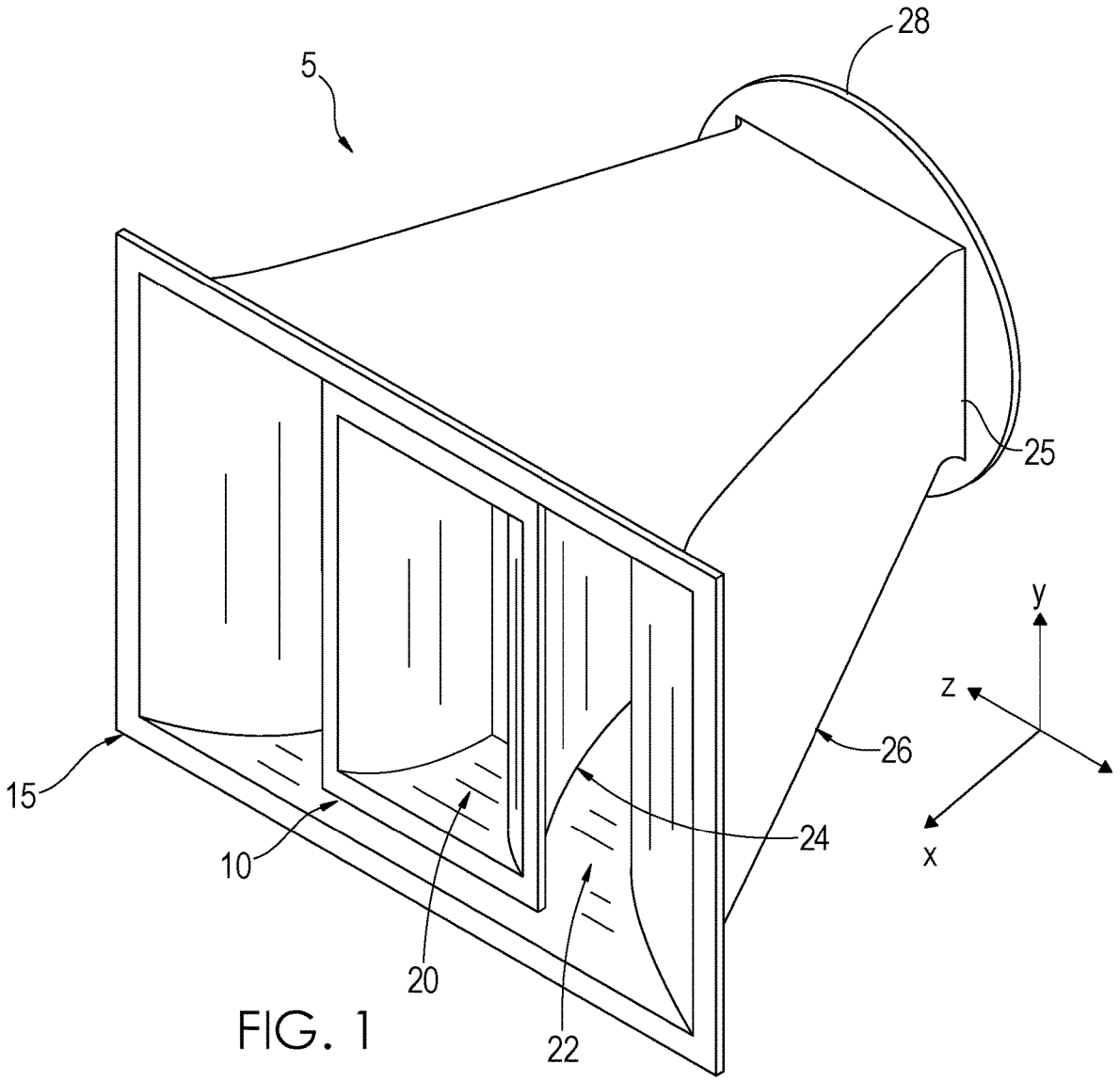
FIG. 1 is a perspective view of a speaker horn in accordance with the present invention.

The present disclosure generally pertains to systems and methods for providing sound using a coaxial sound system, particularly during watersports. The sound system include horns positioned such that their respective longitudinal axes are substantially aligned, i.e., coaxial, in order to achieve better sound output and clarity than conventional near-field speaker arrangements. In this regard, the "coaxial" horn arrangement may allow for enhanced frequency response, yielding better speaker performance over distance, enhancing sound projection and improving a listener's, e.g., skier's, ability to clearly hear sound played by the system at a range of distances and angles relative to the sound system. The coaxial horn arrangement also allows a listener at a distance, e.g., a skier being towed by a watercraft, to hear sounds clearly when noises may be present that otherwise may interfere with the listener's ability to hear.

Conventional loudspeakers mounted on a watercraft tower may emit sound in an unfocused manner, promoting sound distortion and requiring higher sound output at higher volumes in order for the sound to reach a skier behind the watercraft. Thus, although listeners in the watercraft may be positioned below or behind the conventional loudspeakers, e.g., when mounted on a tower of the watercraft, and not in front of the loudspeakers they may nevertheless be exposed to this distorted sound at high volume. This may result in ear fatigue or dangerous sound volumes for listeners in the watercraft, while simultaneously providing only poor quality sound to the skier.

The configuration of the coaxial horn system allows for improved control of sound projection by focusing a path through which the sound energy is projected. This results in more controlled projection of sound than is possible for conventional speakers, allowing for "sound rejection" relative to spaces that are not within the path of the sound projected by the coaxial horn system. In this regard, a significant portion of sound energy from the coaxial horn system is projected through the focused path, allowing for more sound to reach the listener at a given volume level. When the system is mounted on a tower of the watercraft, the system projects sound over the heads of listeners in the watercraft and out of the watercraft toward the skier. Thus, the system is capable of providing sound at a desirable output level to the skier while sparing listeners positioned near the tower of the watercraft, e.g., not within the path of the coaxial horn system, from experiencing uncomfortable or unsafe sound volumes. Further, the sounds projected by the system maintain a substantially consistent level of clarity and volume across a wide range of angles relative to the system, e.g., across an arc defined by the skier's position at an end of the tow rope relative to the towing watercraft.

As an example, in some embodiments, the system includes a first horn body positioned coaxially within a second horn body. The first horn body is coupled to receive sound generated by a first speaker at a first frequency range. A second horn body is positioned coaxially with the first horn body and coupled to receive sound generated by a second speaker at a second frequency range. In some embodiments, the second speaker is positioned adjacent to a mouth of the second horn body but between the first horn body and the first speaker. In this regard, a portion of the first horn body that includes a mouth may extend past the mouth of the second horn and through a portion of the second speaker. The second speaker may include a channel for channeling sound generated by the first speaker to a mouth of the first horn body, which is positioned adjacent to the channel of the second speaker to receive sound from the channel. The first horn projects sound provided from the channel to the mouth of the first horn at the first frequency range, and the second speaker projects sound provided to the mouth of the second horn at the second frequency range. In addition, the arrangement and dimensions of the first and second horn bodies enables handling higher power levels than conventional loudspeakers while retaining compact dimensions. In this regard, the system dimensions make the system suitable for mounting on a tower of a watercraft.

Referring to FIG. 1, there is provided a perspective view of a speaker horn 5 in accordance with the present invention. To achieve better sound clarity and projection, speaker horn 5 includes a first horn body 10 positioned within a second horn body 15 and positioned coaxially with respect to one another. A longitudinal axis of first horn body 10 is aligned with a longitudinal axis of second horn body 15. In other embodiments, the longitudinal axes of first horn body 10 and second horn body 15 may extend parallel to one another.

The co-axial and longitudinal axes alignment arrangement of first horn body 10 and second horn body 15 allows the speaker horn 5 to overcome shortcomings present in current designs, such as phasing of sounds projected by the respective horn bodies. In addition, the arrangement of coaxial horn bodies 10, 15 permits for substantial time alignment of sounds produced from one or more audio signals that are received by speakers operatively coupled to speaker horn 5. Such configuration of the speaker horn 5 lends itself to various applications, including projection of audio in two-way and three-way crossover network configurations, as described in more detail below.

Each horn body 10, 15 may be essentially hollow and coupled to receive sound in one or more frequency ranges from one or more speakers (not specifically shown in FIG. 1). In the embodiment of FIG. 1, both first horn body 10 and second horn body 15 are aligned to project sound received from the speakers in generally the same direction, e.g., in the X-direction of FIG. 1. In addition, although FIG. 1 depicts two horn bodies, as described further below, in some embodiments, other numbers of horn bodies may be used, which may be arranged in various configurations to achieve the functionality described herein. Note that, in some embodiments, first horn body 10 and second horn body 15 may be coupled together to prevent shifting or alteration of components of sound paths that could alter the sound projection of speaker horn 5.

As depicted in FIG. 1, first horn body 10 includes a long range or "long throw" horn body and a mouth (not specifically shown in FIG. 1) and a bell 20. First horn body 10 is configured for amplifying sound that enters first horn body 10 at the mouth and exits through bell 20. The mouth of the horn body 10 (not specifically shown in FIG. 1) may have a smaller area (e.g., diameter, radius, etc.) than the bell 20. Sound may enter the mouth of first horn body 10 and travel through the first horn body 10 until it exits first horn body 10 at the bell 20.

Conventional horns used in the marine industry have a short length and round bell without a defined output pattern. This configuration limits the frequency that is horn loaded only to the upper end of the response, while the short length lowers output. However, as depicted in FIG. 1, first horn body 10 has a curved exterior profile 24, and bell 20 has an essentially rectangular profile, i.e., cross section. Although first horn body 10 and its components may have any suitable dimensions, in an embodiment, first horn body 10 has approximately a 1" diameter mouth (not specifically shown) and is approximately 9.5" in length. Bell 20 is approximately 7" by 4," although other dimensions are possible. In some embodiments, other shapes, profiles, and characteristics of first horn body 10 and its respective components are possible, such as when first horn body 10 has a graduated, curved, or tapered profile, or when its mouth and bell 20 have shapes other than a rectangular profile shape.

Similarly, second horn body 15 includes a long range or "long throw" horn body and has a mouth 25 and a bell 2. Second horn body 15 is configured for amplifying sound that enters the mouth, travels through second horn body 15 and exits bell 22. Second horn body 15 may have a graduated, curved, or tapered profile. As shown in FIG. 1, second horn body 15 has a tapered exterior profile 26. Mouth 25 may have a smaller area, e.g., width, height, diameter, radius, etc., than the bell 22. Second horn body 15 and its components may have any suitable dimensions, although in an embodiment, second horn body 15 has approximately a 5" diameter mouth 25 and is approximately 7.5" in length. Bell 22 is approximately 7" by 7," but other dimensions are possible. As depicted in FIG. 1, second horn body 15 has a bell 22 with an essentially rectangular profile, i.e., cross section, and a tapered exterior profile 26, but in other embodiments, other shapes, profiles, and characteristics of second horn body 15 are possible. In addition, second horn body 15 has an interface 28 coupled to mouth 25 that is configured to couple second horn body 15 to receive sound from a speaker, as described further below.

Figure 2:
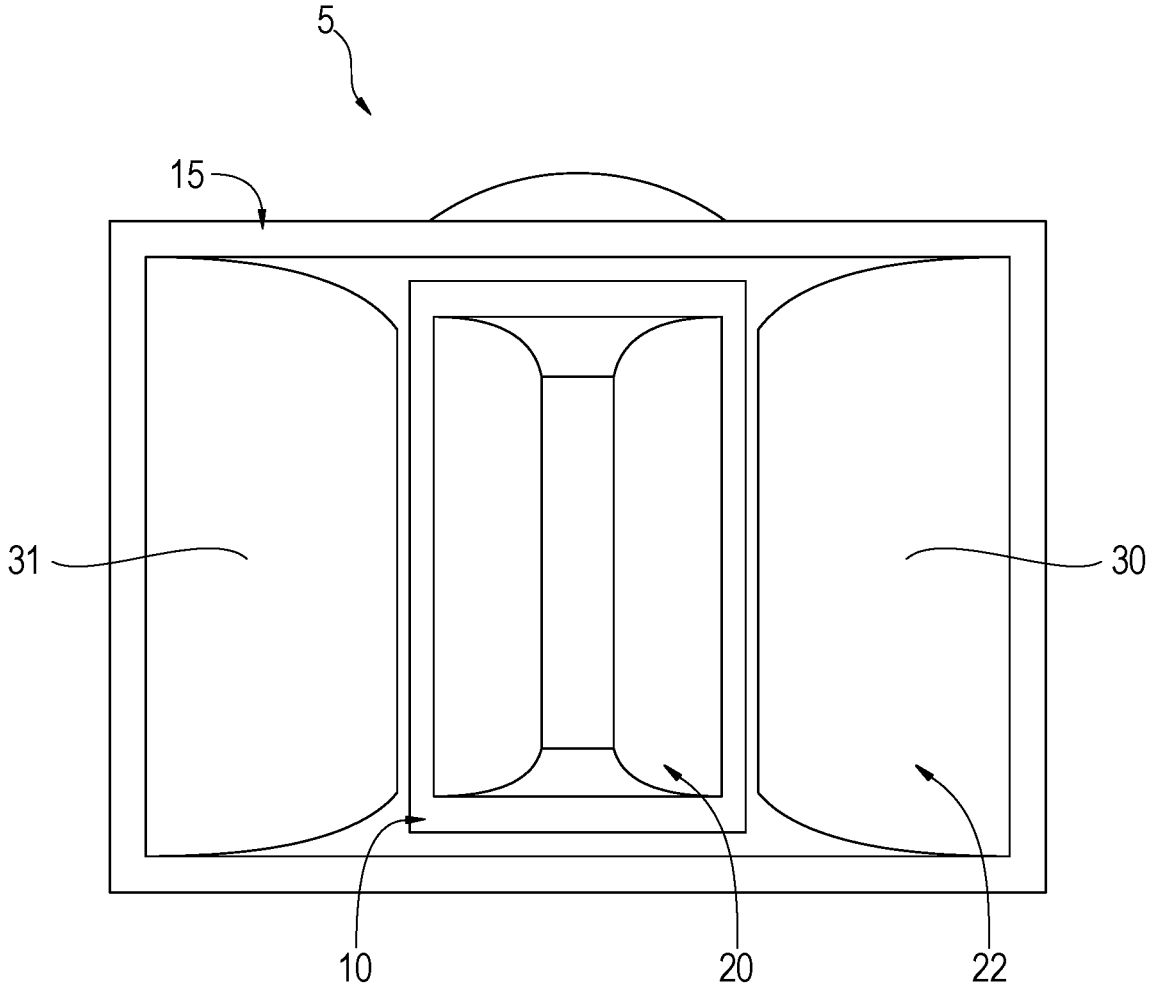
FIG. 2 is an elevational view of a front of the speaker horn of FIG. 1.

Referring to FIG. 2, there is provided a front elevational view of speaker horn 5 illustrating first horn body 10 positioned substantially in a center portion within of second horn body 15. Space is present between respective outer sides of first horn body 10 and inner sides 30 and 31 of second horn body 15, essentially forming a path or cavity for sound, i.e., from the second speaker, described further below. In this regard, sound provided from a speaker coupled to second horn body 15 travels through the space between first horn body 10 and second horn body 15 and projects from the bell 22 of second horn body 15. Space defined within first horn body 10 provides a path or cavity for sound, i.e., from a first speaker, described below. Note that inner sides 30, 31 of second horn body 15 may have various profiles. As illustrated in FIG. 2, inner sides 30, 31 have essentially curved profiles. Similarly, inner sides of first horn body 10 have curved inner sides.

Figure 3:
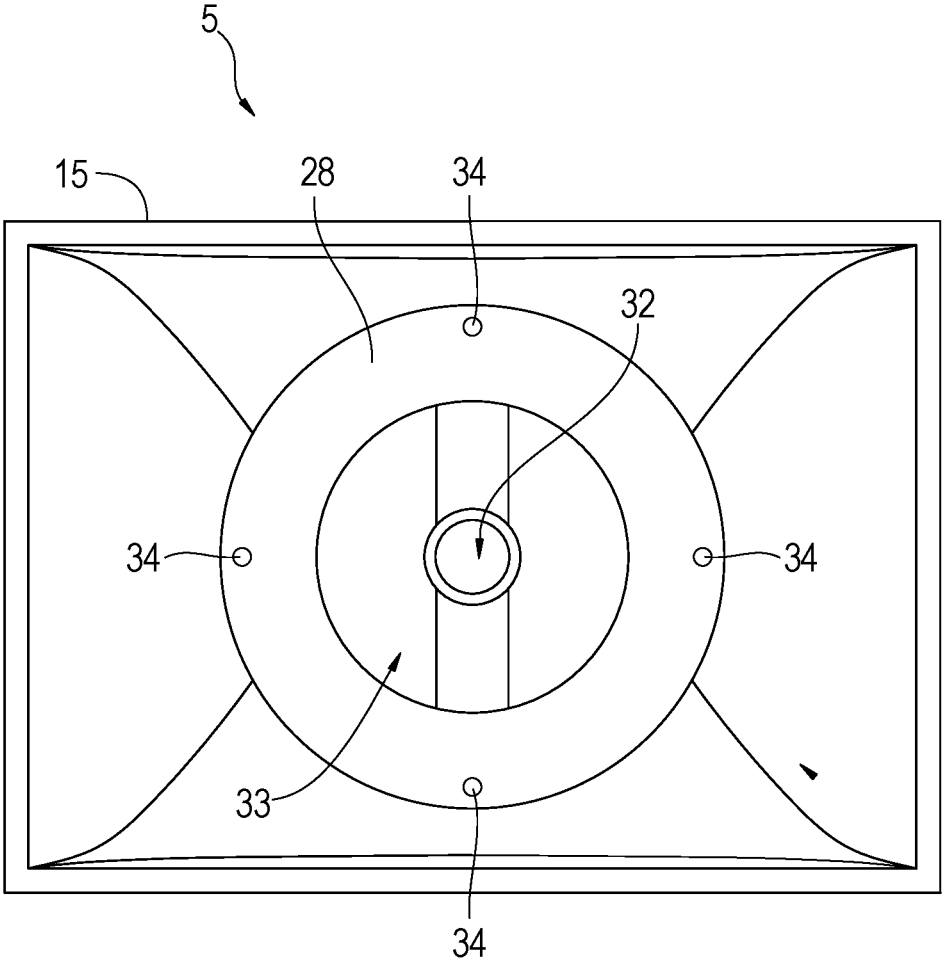
FIG. 3 is an elevational view of a rear of the speaker horn of FIG. 1.

Referring to FIG. 3, there is provided a rear elevational view of speaker horn 5. A mouth 32 of first horn body 10 is visible and is depicted as being positioned within interface 28. A second speaker may couple to the second horn body 15 using various techniques, such as by threading screws or other hardware fasteners through one or more holes 34 on the interface 28. Note that there is a space 33 between interface 28 and mouth 32 so that sound may travel through space 33 between mouth 32 and interface 28. When first horn body 10 and second horn body 15 are each coupled to receive sound from respective speakers (not shown in FIG. 3), sound from a first speaker may be channeled to mouth 32, then travel through mouth 32 and through first horn body 10. Sound from a second speaker may travel through space 33 between mouth 32 and interface 28 and travel through second horn body 15.

Figure 4:
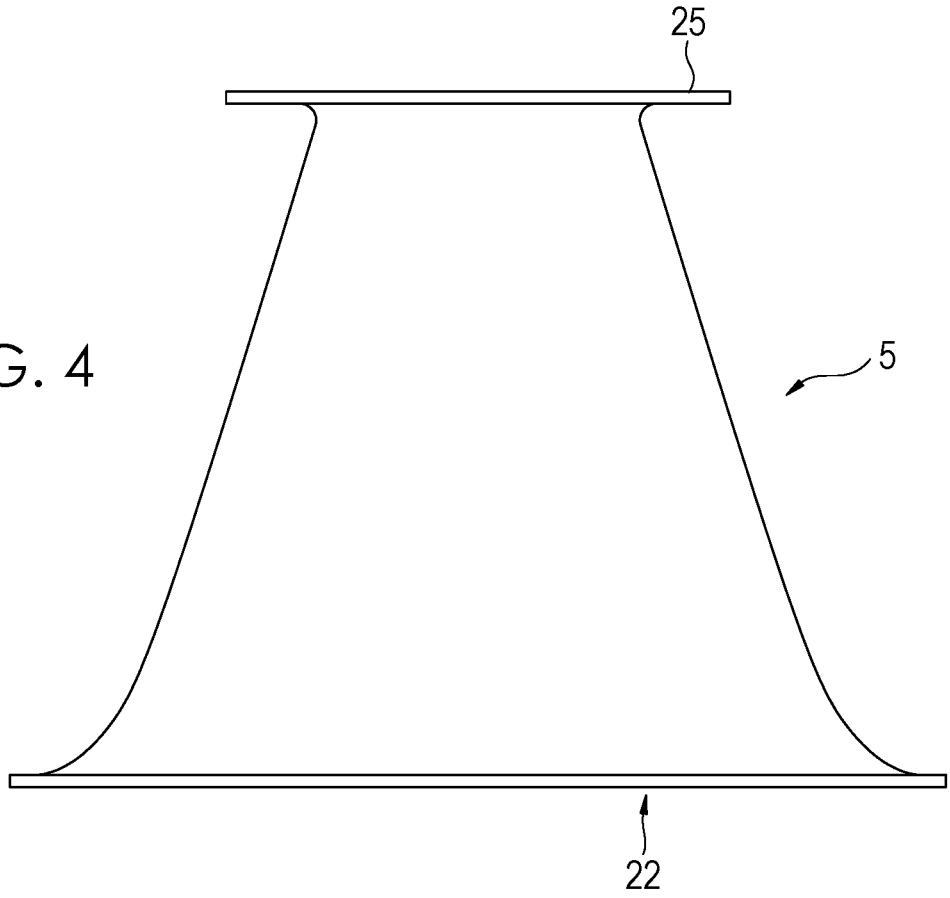
FIG. 4 is a top plan view of the speaker horn of FIG. 1.
Figure 5:
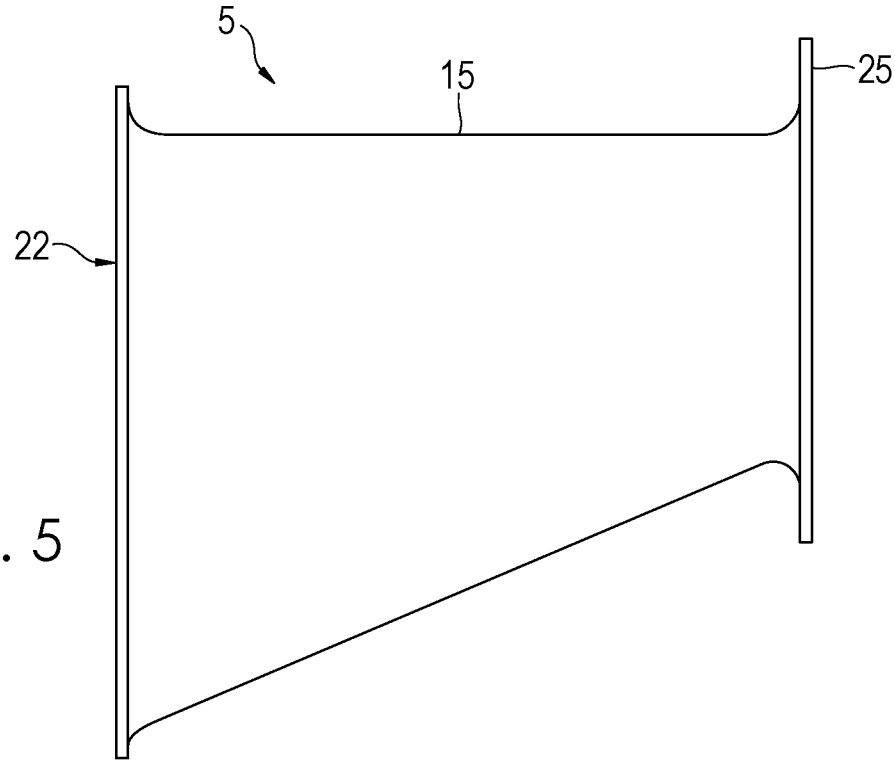
FIG. 5 is an elevational view of a side of the speaker horn of FIG. 1.

Referring to FIGS. 4 and 5, there are provided a top plan view and a side elevational view, respectively, of speaker horn 5. As depicted in FIGS. 4 and 5, first horn body 10 does not extend beyond second horn body 15. That is, first horn body 10 is essentially contained within second horn body 15, although in other embodiments, portions of first horn body 10 may extend forward beyond second horn body 15. Note also that mouth 25 and bell 22 include a flange or lip. Furthermore, as best depicted in FIG. 5, mouth 25 is offset vertically from the bell 22. In some embodiments, mouth 25 may be essentially aligned with the bell 22, or may be positioned with respect to bell 22 as desired to achieve various functionalities, such as integration within a multi-speaker configuration. The dimensions and particular configuration and shapes of second horn body 15 may vary.

Figure 6:
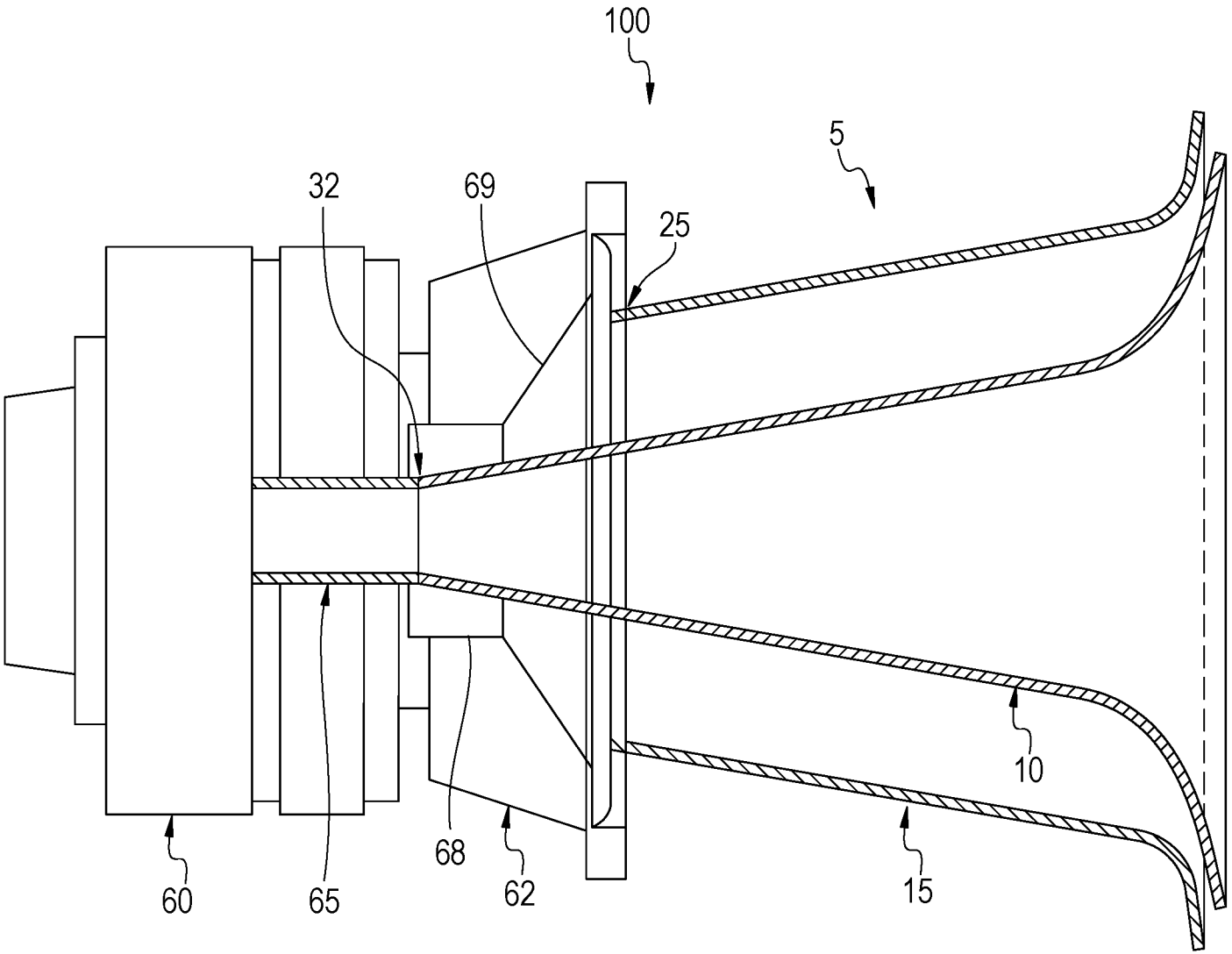
FIG. 6 is a sectional view of a two-way, coaxial speaker system in accordance with the present invention utilizing the speaker horn of FIG. 1.
Figure 7:
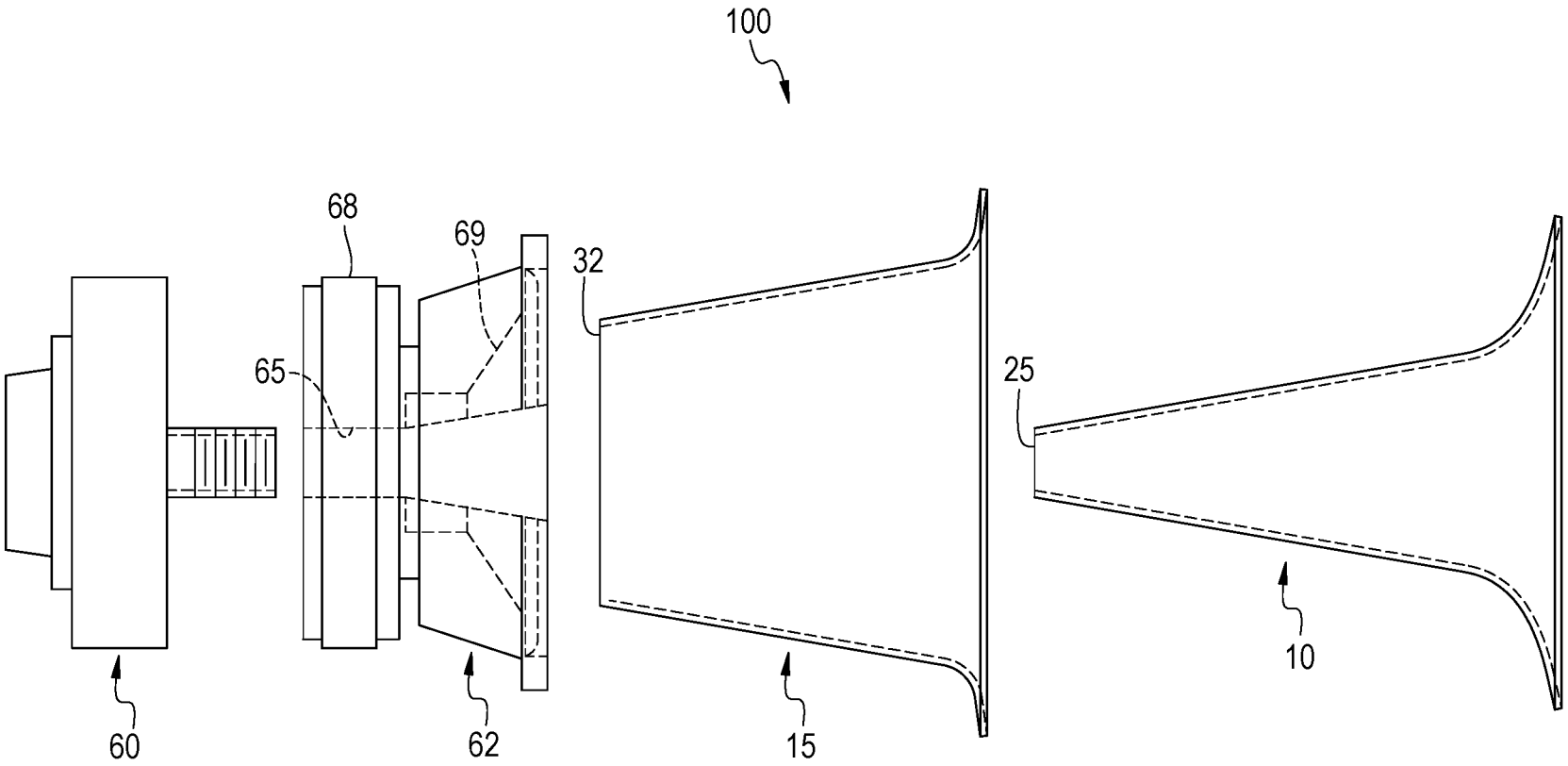
FIG. 7 is an exploded view of the two-way, coaxial speaker system of FIG. 6.

Referring to FIGS. 6 and 7, there are provided a sectional view and an exploded view, respectively, of a two-way, coaxial speaker system 100 in accordance with the present invention utilizing speaker horn 5. System 100 includes two speakers arranged in series, i.e., coaxially, that produce sound in two different audio frequency ranges and provide the sound for projection through horn bodies 10, 15. System 100 may be configured as a crossover network to split frequencies into one or more ranges. A first speaker 60 is coupled to a rear portion of a second speaker 62 and is configured to generate and provide sound for projection via first horn body 10. First speaker 60 can be various types of speakers, e.g., driver, tweeter, woofer, etc., and can be configured to generate and output sound in various frequency bands. In some embodiments, first speaker 60 is configured as a high-frequency compression driver, e.g., 1" compression driver, operable to generate sound in a high audio frequency range, e.g., 2000 Hz to 20 kHz, and provide it for projection via first horn body 10. First speaker 60 is configured to couple to second speaker 62 via various techniques, but as illustrated, first speaker 60 includes a threaded portion for screwing into a channel 65 of second speaker 62, as described further below.

Similarly, second speaker 62 can be various types of speakers, e.g., driver, tweeter, woofer, etc., and can be configured to generate and output sound in various frequency bands. In some embodiments, second speaker 62 may be various types of speakers, e.g., 8" mid-bass loudspeaker, configured to generate sound in a mid-range audio frequency band, e.g., 400 Hz to 3.5 kHz. Second speaker 62 is coupled to mouth 25 of second horn body 15 via interface 28 and is configured to output sound for sound projection via second horn body 15.

In order to preserve sound quality as sound moves through system 100, components of system 100 may have an essentially airtight or "compression fit." In particular, first speaker 60, second speaker 62 and first horn body 10 may be joined together using a compression-fit technique. First speaker 60 may have an essentially air tight compression fit to second speaker 62, which may have an essentially airtight compression fit to first horn body 10. In some embodiments, second speaker 62 also may be compression fit to second horn body 15. The various components of system 100 may be respectively coupled together using other techniques in other embodiments.

Second speaker 62 includes a channel 65 that is configured to channel sound generated by first speaker 60 to first horn body 10. As depicted in FIG. 6, channel 65 passes through a magnet 68 of second speaker 62 and through a cone 69 of second speaker 62. In some embodiments, the channel 65 may pass through any suitable components of second speaker 62, including a magnet 68, cone 69 or other component of speaker 62. Channel 65 terminates adjacent to or is coupled to mouth 32 of first horn body 10 such that sound from first speaker 60 is directed through channel 65 and into first horn body 10. A portion of first horn body 10 may extend past mouth 25 of second horn body 15 through second speaker 62, e.g., through magnet 68, cone 69 or other component of speaker 62, such that mouth 32 of first horn body 10 is positioned adjacent to channel 65 to receive sound from first speaker 60.

First speaker 60 is coupled to second speaker 62 by screwing onto a threaded portion of second speaker 62 that extends from channel 65. Alternatively, first speaker 60 may have a threaded portion for screwing into a threaded portion of channel 65. In this regard, when coupled together in this manner, sound from first speaker 60 passes through channel 65 and is provided to mouth 32 of first horn body 10. Sound from second speaker 62 is similarly provided to mouth 25 of and directed into second horn body 15.

Note that although two speakers are described with regard to FIGS. 6 and 7, in some embodiments, various numbers of speakers are possible. For example, the functionality ascribed to first and second speakers 60, 62 may be performed by one or more coaxial drivers in some embodiments. In addition, although the term "speaker" may be used herein to refer to first speaker 60 and second speaker 62, the term "speaker" also may be used to refer to various components configured to convert audio signals to sound waves and operative to achieve the functionality described herein, as may be apparent to one of ordinary skill in the art.

Figure 8:
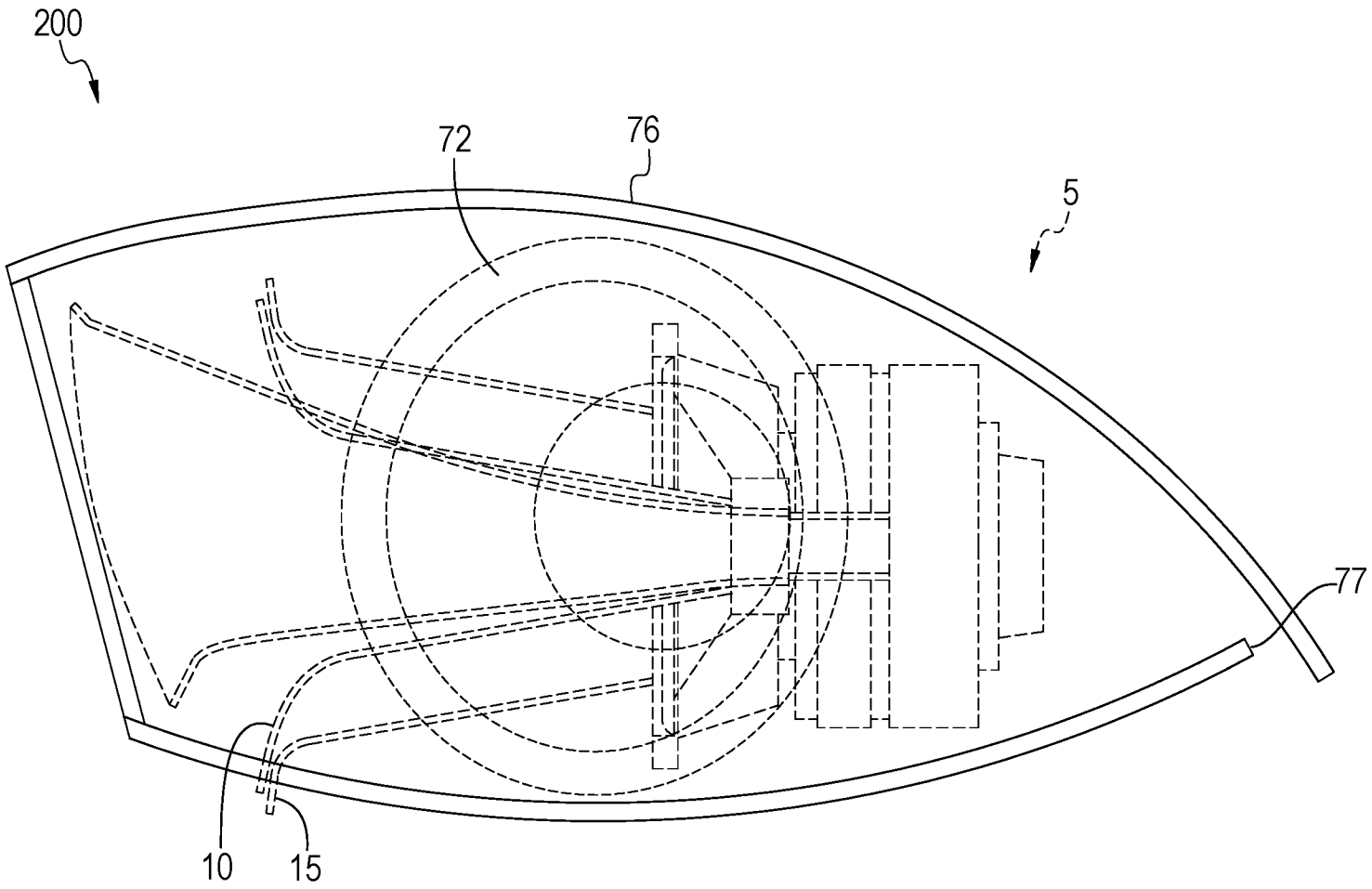
FIG. 8 is a fragmented, perspective of a side of the three-way, co-axial speaker system in accordance with present invention.
Figure 9:
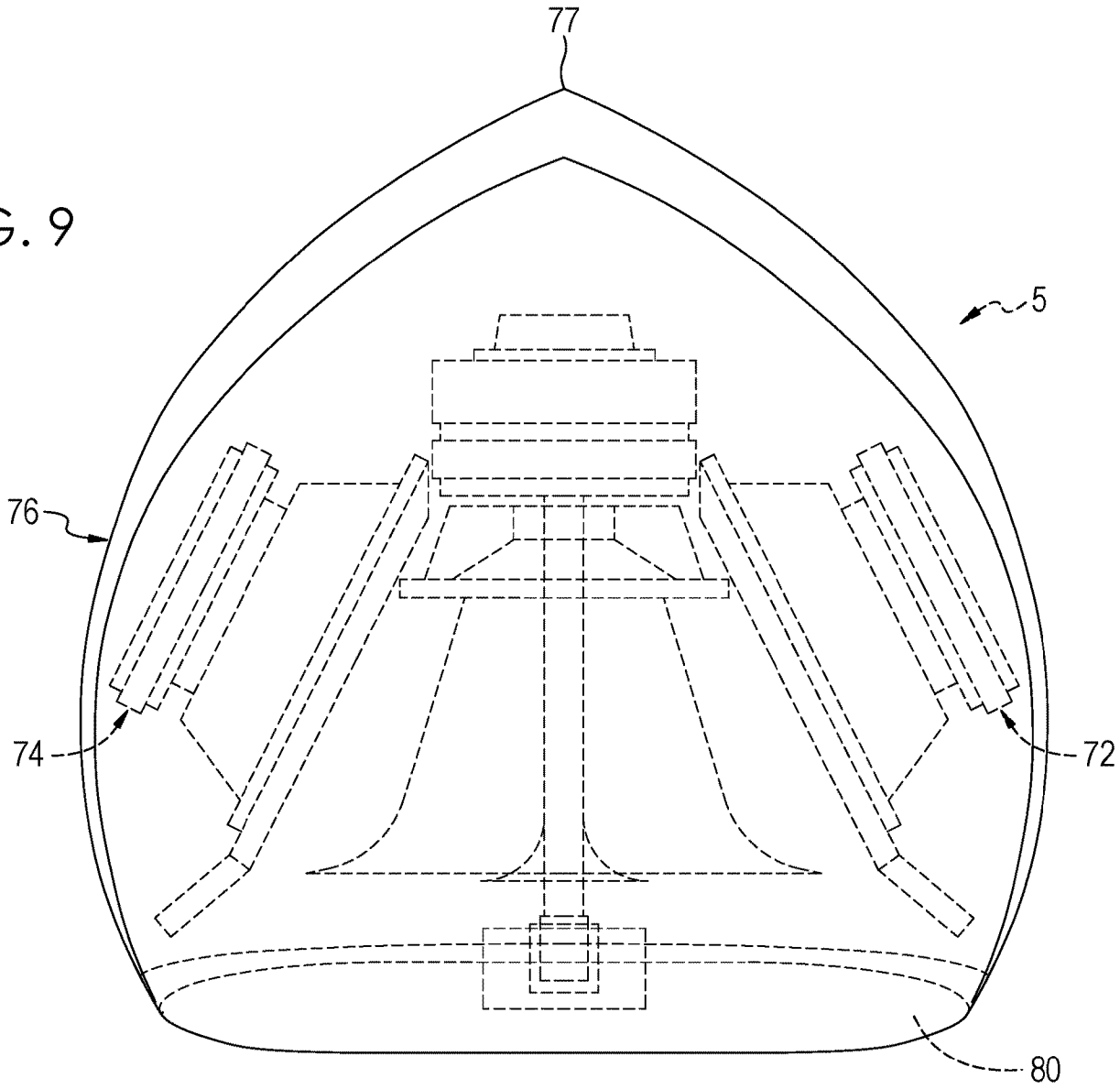
FIG. 9 is fragmented, perspective view of the top of three-way, co-axial speaker system of FIG. 8.
Figure 10:
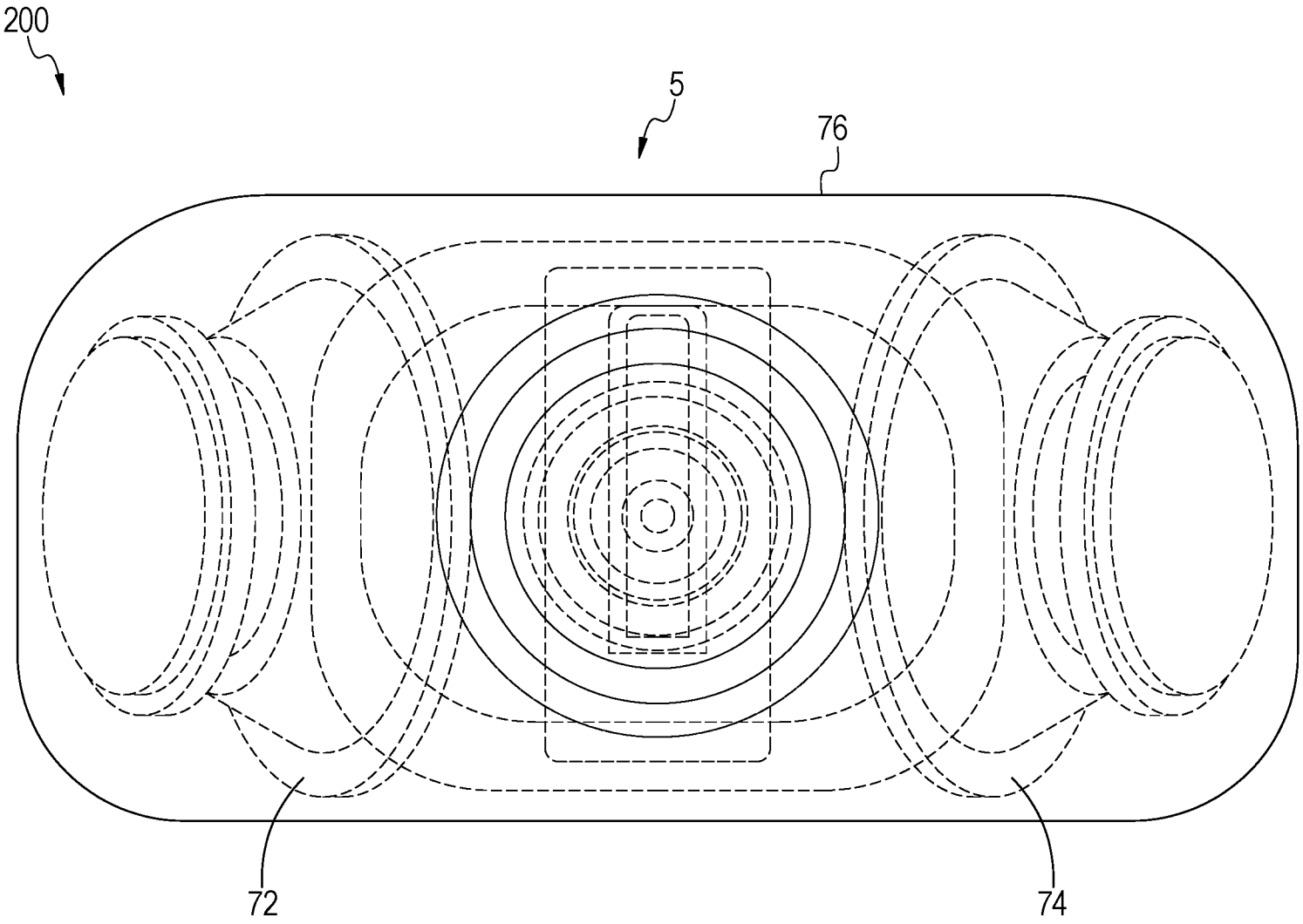
FIG. 10 is a fragmented, perspective view of a rear of the three-way, co-axial speaker system of FIG. 8.

Referring to FIGS. 8 through 10, there is depicted a three-way, co-axial speaker system 200 incorporating system 100, all of which are contained within a single, compact housing that is configured for attachment to a watercraft tower and delivering quality sound to a skier towed behind the watercraft. As noted above, each horn body of the system 100 is configured to receive sound from a speaker in a particular frequency range. Projection of sounds across additional audio frequency ranges may be desired, such as a bass audio frequency range. Thus, in some embodiments, system 100 may incorporate additional speakers configured to play sounds in the desired ranges. System 200 allows for improved power handling, output and lower frequency response compared to system 100. For example, system 100 may have a frequency response of approximately 100 Hz to 18 kHz, with power handling of approximately 500 Watts ($W_{RMS}$) and an efficiency of approximately 99 decibels (dB) for 1 W at 1 meter (m). System 200 may have a frequency response of approximately 80 Hz to 18 kHz, with power handling of approximately 1200 $W_{RMS}$ and an efficiency of approximately 101 dB for 1 W at 1 m.

System 200 includes three types of speakers configured to output sound across a high frequency, mid-bass frequency, and bass audio frequency ranges, respectively, and may be configured as a crossover network. System 200 includes first speaker 60 and second speaker 62 as described for system 100, except that first speaker 60 and second speaker 62 are approximately 6.5" in diameter. In addition, system 200 has two additional approximately 8" bass speakers 72 and 74 that are configured to provide sound in the bass audio frequency range. FIG. 9 shows exemplary positions of bass speakers 72, 74 relative to the other components of system 200, but note that positions of the components described herein may be varied slightly to achieve the functionality described herein or otherwise as desired. First speaker 60 and second speaker 60 are coupled to first horn body 10 and second horn body 15 as noted above with regard to system 100

System 5 is enclosed within a housing 76 to allow for secure and reliable installation to and use within a watercraft, such as on a ski boat tower. Housing 76 is configured to stabilize system 200 and permit coupling of the system as desired (such as to a tower of a watercraft configured for towing a skier). Although not specifically shown in FIGS. 8 through 10, housing 76 may comprise various components, e.g., hardware, to facilitate secure and reliable positioning of components of systems 100 or 200 within housing 76 despite exposure of the systems to various degrees of dynamic loading, such as during operation of a watercraft carrying the systems at a range of speeds and performing a variety of maneuvers. Housing 76 may also include various mounting hardware for coupling the housing to the watercraft, such as to a ski tower or otherwise. Further, although housing 76 is depicted as a baffle, other types of housings are contemplated. Since housing 76 is intended for attachment to a watercraft, the exterior of housing 76 is aerodynamically contoured to reduce drag as the watercraft travels through a body of water. To that end, housing 76 has a flattened-bullet shape with a speaker end of system 100 being disposed within a leading or generally pointed end of housing 76 with the horn-end being disposed with in a following end of the housing.

The speakers of system 200, i.e., first and second speaker 60, 62 and the bass speakers 72, 74, may be coupled in various positions, but in as provided in FIGS. 8 through 10, the speakers are shown as being oriented at an angle relative to a front opening 80 of housing 76. In this regard, first and second horn bodies 10, 15 are likewise oriented toward opening 80 to facilitate projection of sound to the listener through opening 80, as described herein. Sound generally may be channeled through opening 80 during operation of system 200.

Figure 11:
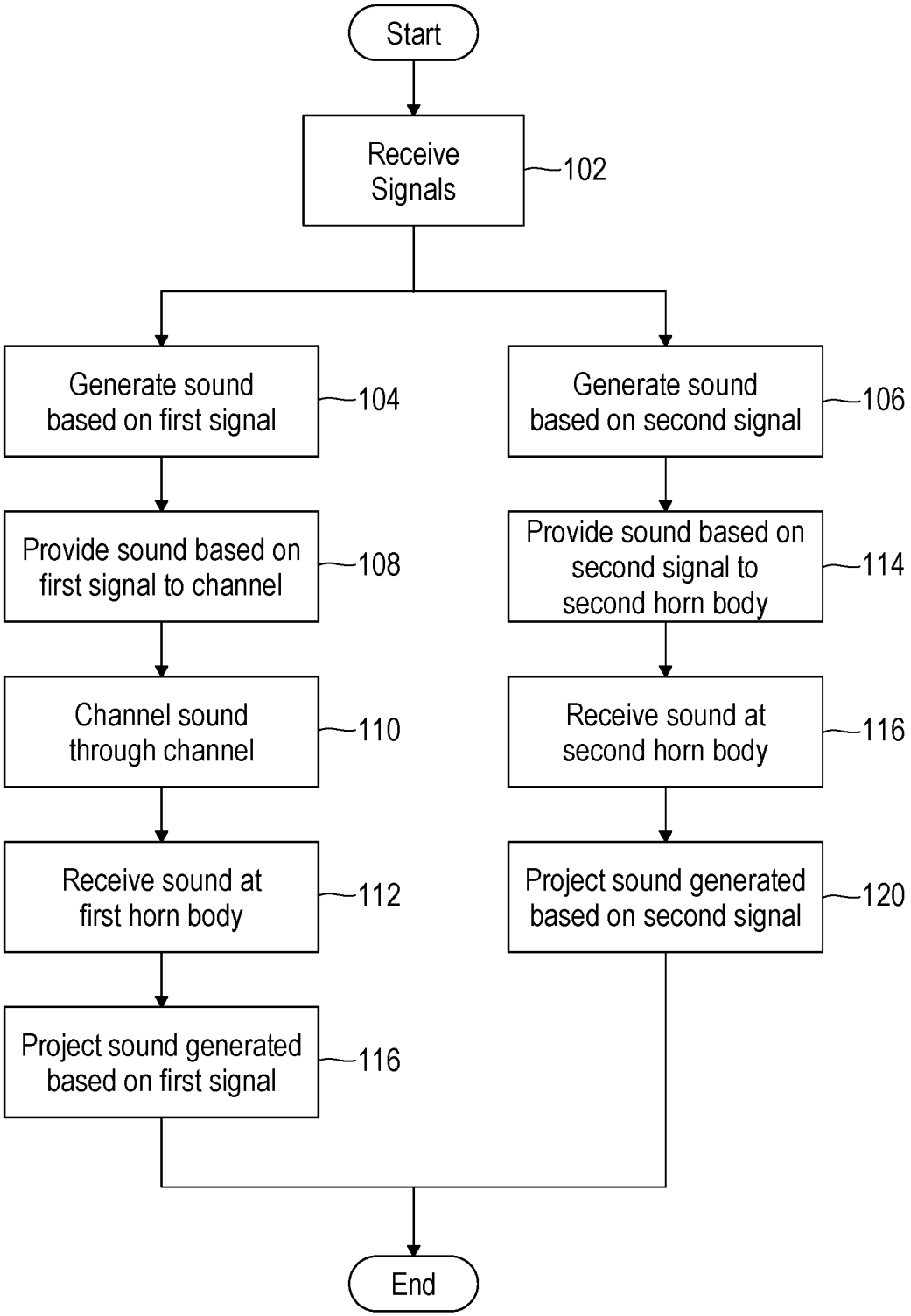
FIG. 11 depicts a non-limiting flow diagram illustrating exemplary methods for providing sound using a coaxial sound system.

Referring to FIG. 11, there is depicted a non-limiting flow diagram illustrating exemplary methods for providing sound using a coaxial sound system in accordance with system 100. Note that the various steps identified in FIG. 11 may be performed at various times as desired, such as essentially simultaneously or otherwise to achieve the functionality described herein. Processing begins at step 102, where audio signals are received by each of first speaker 60 and second speaker 62 of the system 100. At step 104, a first signal is processed by first speaker 60, such as a high-frequency audio signal, and first speaker 60 generates sound based on the first signal. At step 106, a second signal is processed by second speaker 62, such as a mid-range frequency audio signal, and second speaker 62 generates sound based on the second signal.

At step 108, sound based on the first signal is provided to channel 65 of second speaker 62. The sound is channeled through channel 65 at step 110, and at step 112 may enter first horn body 10 coupled to receive the sound from channel 65. First horn body 10 is coupled to channel 65 using various techniques, such as screwing to one another via threaded portions of the respective first horn body 10 and channel 65.

At step 114, sound based on the second signal is provided to second horn body 15 coupled to receive the sound from second speaker 62. At step 116, second horn body 15 receives the sound generated based on the second signal.

At step 118, first horn body 10 projects sound passing through it that was generated and provided based on the first signal. At step 120, second horn body 15 projects sound passing through it that was generated and provided based on the second signal. Thereafter processing may end.

The foregoing is merely illustrative of the principles of this disclosure and various modifications may be made by those skilled in the art without departing from the scope of this disclosure. The above described embodiments are presented for purposes of illustration and not of limitation. The present disclosure also can take many forms other than those explicitly described herein. Accordingly, it is emphasized that this disclosure is not limited to the explicitly disclosed methods, systems, and apparatuses, but is intended to include variations to and modifications thereof, which are within the spirit of the following claims.

What is claimed is:

1. A sound system comprising:

a coaxial speaker horn including, a first horn body having a first opening, a first mouth and a first sound pathway extending between the first opening and the first mouth, a second horn body having a second opening, a second mouth and a second sound pathway extending between the second opening and the second mouth, wherein the first horn body is contained within the second horn body and includes a longitudinal axis that is aligned with a longitudinal axis of the second horn body, and the first pathway and the second pathway are separated from one another by a first horn body continuous sidewall, a first speaker operatively coupled to the first horn body and arranged to project sound into the first horn body through the first mouth, through the first sound pathway and out of the first horn body through the first opening, a second speaker operatively coupled to the second horn body and arranged to project sound into the second horn body through the second mouth, through the second sound pathway and out of the second horn body through the second opening, and a channel extending through a central opening of the second speaker, the channel operatively coupling the first sound pathway to the first speaker, wherein the sound system is a far-field sound system.

2. The system of claim 1, wherein the second sound pathway includes a left pathway and a right pathway separated from one another by the first horn body.

3. The system of claim 1, wherein the first speaker operates at a high audio frequency range and the second speaker operates at a mid-range audio frequency range.

4. The system of claim 1, wherein each of the first speaker and the second speaker is a compression driver speaker.

5. The system of claim 1, wherein the channel includes a longitudinal axis that is aligned with the longitudinal axis of the second horn body.

6. The system of claim 1, further comprising a third speaker configured to provide sound in a third frequency range.

7. The system of claim 6, wherein the third frequency range comprises a bass audio frequency range, and wherein third speaker is not positioned coaxially with the first speaker.

8. The system of claim 1, including a housing containing the coaxial speaker horn, the first speaker and the second speaker, wherein the housing is configured to lessen drag of the system when carried on a watercraft.

9. The system of claim 8, wherein the housing is substantially bullet-shaped.

10. The system of claim 8, wherein the housing is coupled to a watercraft and arranged to direct sound from the first sound pathway and the second sound pathway behind the watercraft.

11. The system of claim 1 wherein the first mouth has diameter of about 1 inch, the first horn body has a length of about 9.5 inches, the second mouth has a diameter of about 5 inches and the second horn body has a length of about 7.5 inches.

12. A sound system comprising:

a coaxial speaker horn including, a first horn body having a first opening, a first mouth and a first sound pathway extending between the first opening and the first mouth, a second horn body having a second opening, a second mouth and a second sound pathway extending between the second opening and the second mouth, wherein the first horn body is contained within the second horn body and includes a longitudinal axis that is aligned with a longitudinal axis of the second horn body, and the first pathway and the second pathway are separated from one another by a first horn body continuous sidewall, a first speaker operatively coupled to the first horn body and arranged to project sound into the first horn body through the first mouth, through the first sound pathway and out of the first horn body through the first opening, a second speaker operatively coupled to the second horn body and arranged to project sound into the second horn body through the second mouth, through the second sound pathway and out of the second horn body through the second opening, and a third speaker arranged adjacent to a first side of the second horn body, a fourth speaker arranged adjacent to a second side of the second horn body and a housing containing the coaxial speaker horn, the first speaker, the second speaker, the third speaker and the fourth speaker, wherein the sound system is a far-field sound system.

13. The system of claim 12, wherein the third speaker and the fourth speaker are arranged to direct sound towards the second horn body.

14. A sound system comprising:

a coaxial speaker horn including, a first horn body having a first opening, a first mouth and a first sound pathway extending between the first opening and the first mouth, a second horn body having a second opening, a second mouth and a second sound pathway extending between the second opening and the second mouth, wherein the first horn body is contained within the second horn body and includes a longitudinal axis that is aligned with a longitudinal axis of the second horn body, and the first pathway and the second pathway are separated from one another by a first horn body continuous sidewall, a first speaker operatively coupled to the first horn body and arranged to project sound into the first horn body through the first mouth, through the first sound pathway and out of the first horn body through the first opening, wherein the first speaker operates at a high audio frequency range, a second speaker operatively coupled to the second horn body and arranged to project sound into the second horn body through the second mouth, through the second sound pathway and out of the second horn body through the second opening, wherein the second speaker operates at a mid-range audio frequency range, a third speaker arranged adjacent to a first side of the second horn body, wherein the third speaker operates at a bass audio frequency range, a fourth speaker arranged adjacent to a second side of the second horn body, wherein the fourth speaker operates at a bass audio frequency range, and a housing containing the coaxial speaker horn, the first speaker, the second speaker, the third speaker and the fourth speaker, wherein the housing is configured for coupling to a watercraft tower, wherein the sound system is a far-field sound system.

15. The system of claim 14, wherein the first mouth has diameter of about 1 inch, and the first horn body has a length of about 9.5 inches.

16. The system of claim 14, wherein the second mouth has a diameter of about 5 inches and the second horn body has a length of about 7.5 inches.

17. A method of directing sound to a skier towed up to 80 feet or more behind a watercraft while reducing the intensity of the sound within the watercraft including coupling the sound system of claim 14 to the watercraft tower and directing sound from the sound system towards the skier.

* * * * *